US008458973B1

(12) United States Patent
Powers, Jr.

(10) Patent No.: US 8,458,973 B1
(45) Date of Patent: Jun. 11, 2013

(54) TIE BEAM FORMATION APPARATUS AND METHOD

(76) Inventor: John Powers, Jr., Phoenix, AZ (US)

( * ) Notice: Subject to any disclaimer, the term of this patent is extended or adjusted under 35 U.S.C. 154(b) by 3080 days.

(21) Appl. No.: 10/687,197

(22) Filed: Oct. 16, 2003

(51) Int. Cl.
*E04B 2/00* (2006.01)
*E04G 11/06* (2006.01)

(52) U.S. Cl.
USPC ..... 52/293.2; 52/293.3; 52/425; 52/426; 52/435; 52/432; 52/285.3; 52/562; 52/309.11; 249/19; 249/34

(58) Field of Classification Search
USPC ..... 52/92.2, 699, 702, 432, 562, 92.1, 52/91.2, 4.4, 293.3, 285.3, 435, 309.11, 425–426; 249/19, 34
See application file for complete search history.

(56) References Cited

U.S. PATENT DOCUMENTS 2,358,975 A * 9/1944 Hillberg ..... 249/46
2,947,119 A * 8/1960 Puckett, Jr. ..... 52/699
3,304,674 A * 2/1967 Ward ..... 52/233
4,185,804 A * 1/1980 Baculo ..... 249/20
4,409,764 A * 10/1983 Wilnau ..... 52/127.3
5,000,621 A * 3/1991 Beamer ..... 405/282
5,335,470 A * 8/1994 Alvarez ..... 52/699
5,560,167 A * 10/1996 Miceli ..... 52/285.4
5,983,585 A * 11/1999 Spakousky ..... 52/405.4
6,389,778 B1 * 5/2002 Strange ..... 52/745.19
6,519,906 B2 * 2/2003 Yost et al. ..... 52/426
6,560,938 B1 * 5/2003 Powers, Jr. ..... 52/204.2

* cited by examiner

*Primary Examiner* — Jeanette E. Chapman
(74) *Attorney, Agent, or Firm* — Parsons & Goltry; Robert A. Parsons; Michael W. Goltry

(57) ABSTRACT

Tie beam formation apparatus includes parallel opposed sidewalls defining a channel constructed to receive concrete for the formation of a tie beam. The sidewalls are disposed to become a fixed part of the tie beam. The apparatus further includes mounting structure attached to the sidewalls for holding the sidewalls in the channel defining position. The mounting structure is designed to hold the sidewalls on an upper surface of a block wall and to engage the sidewalls with the block wall at regular intervals. The mounting structure is further designed to allow a flow of concrete into openings in the block wall at spaced apart regular intervals.

7 Claims, 6 Drawing Sheets

FIG. 9
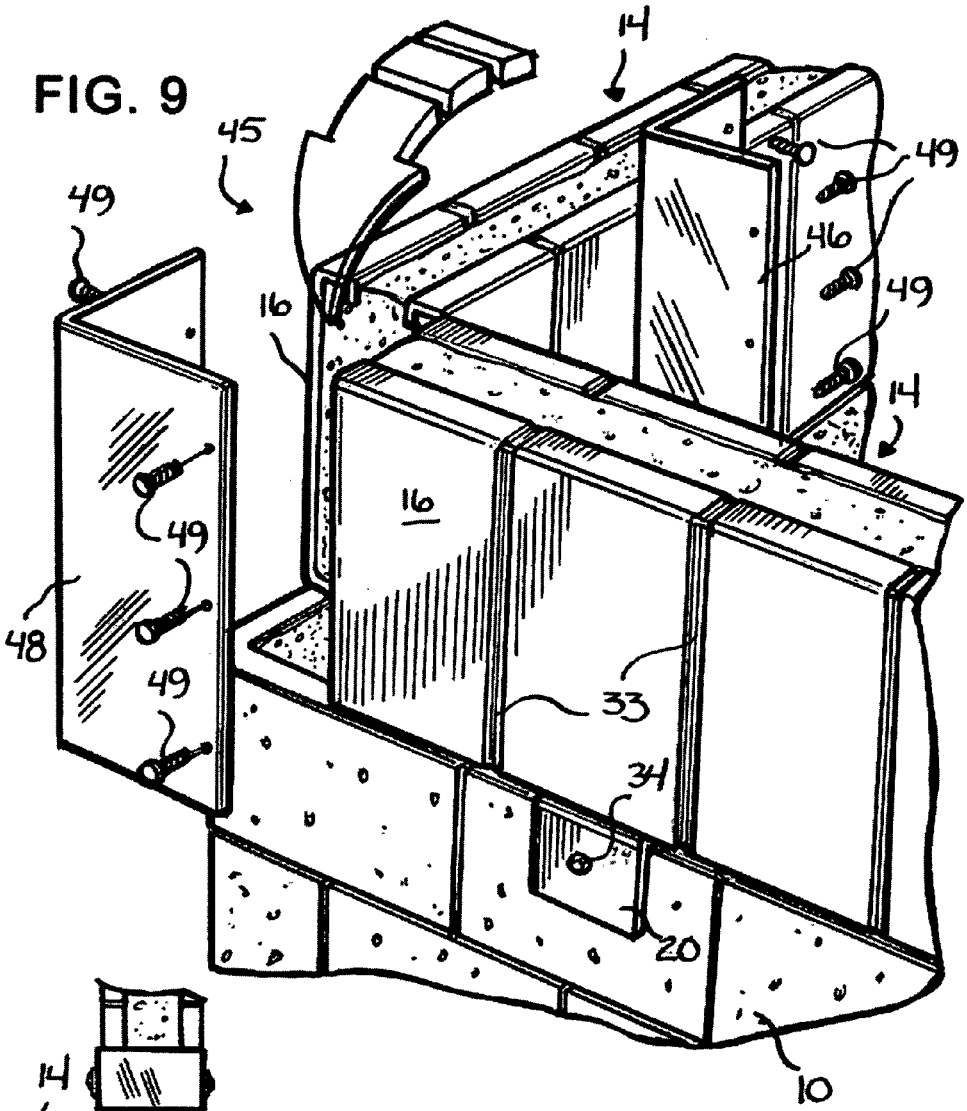
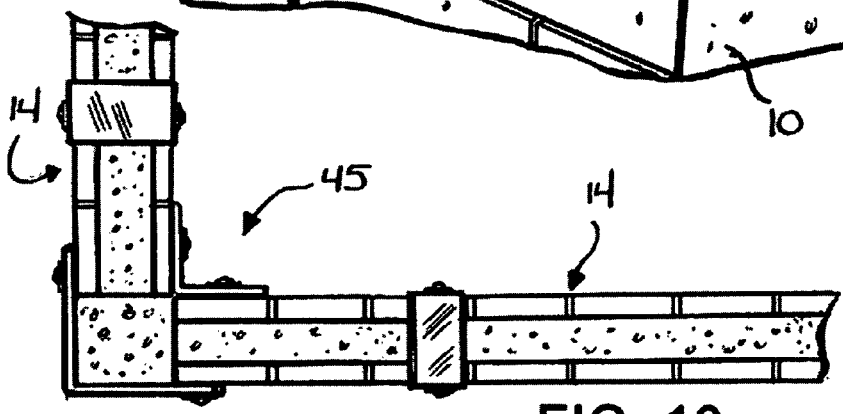
FIG. 10

FIG. 11
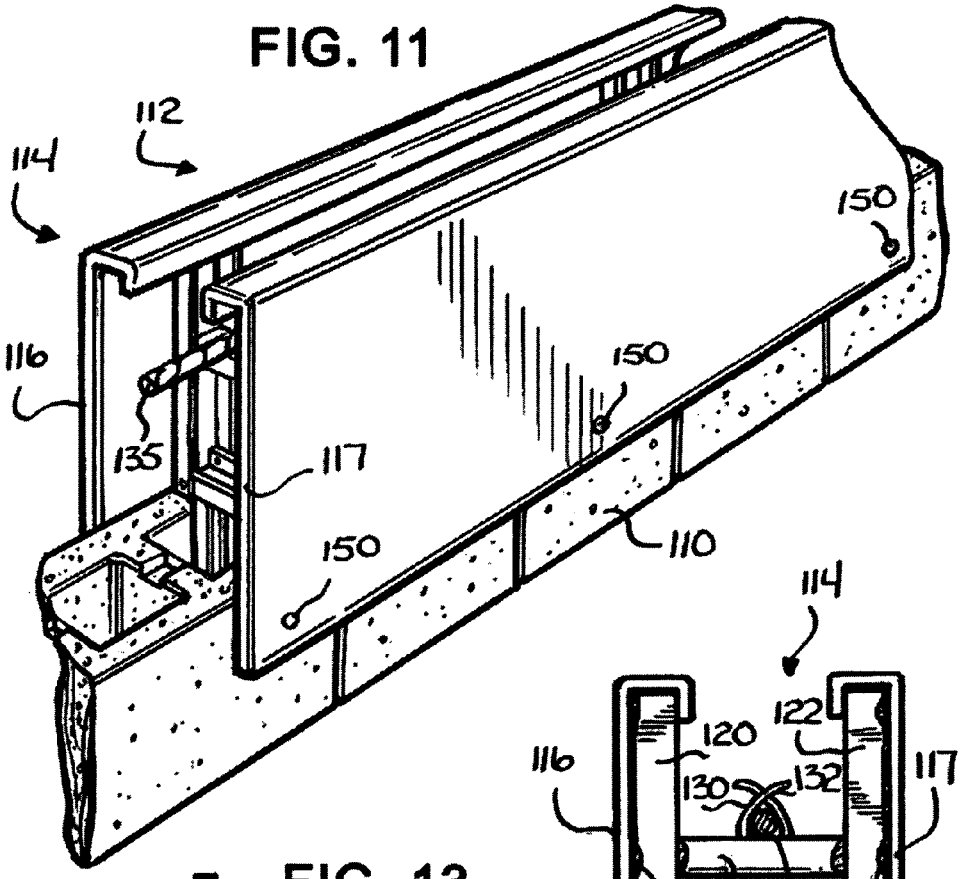
FIG. 13
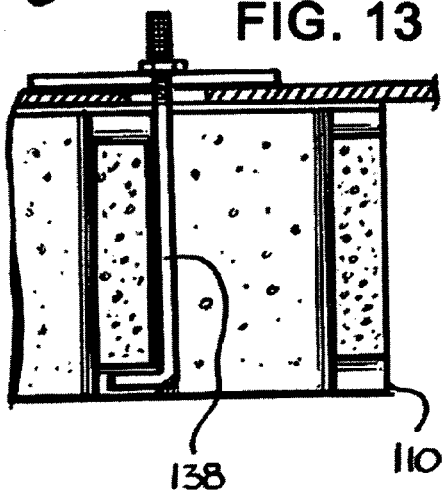
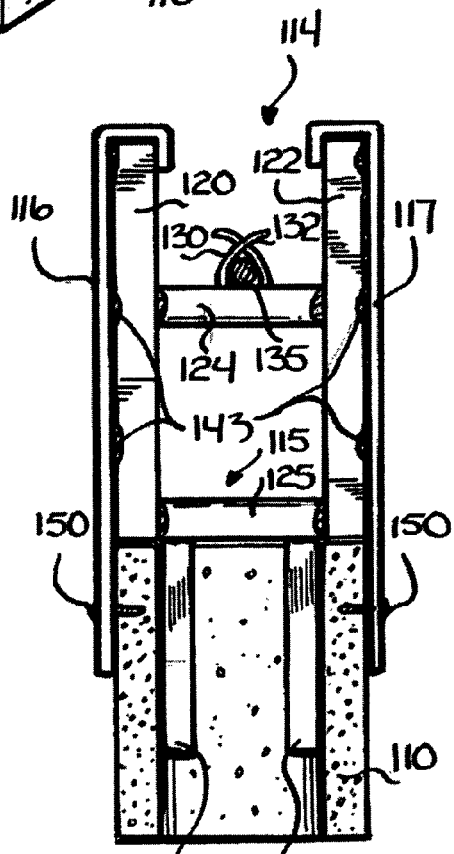
FIG. 12

FIG. 15
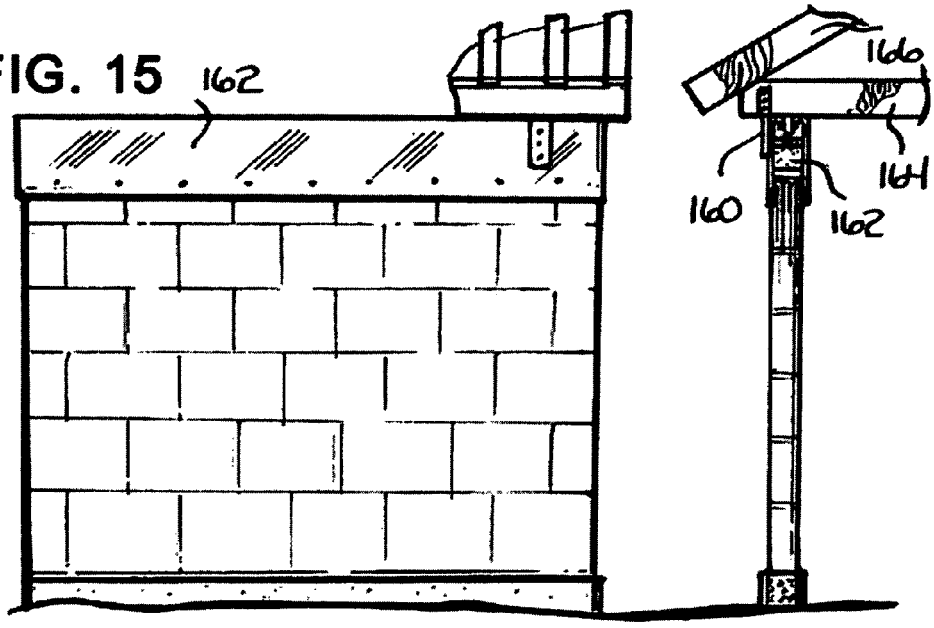
FIG. 16
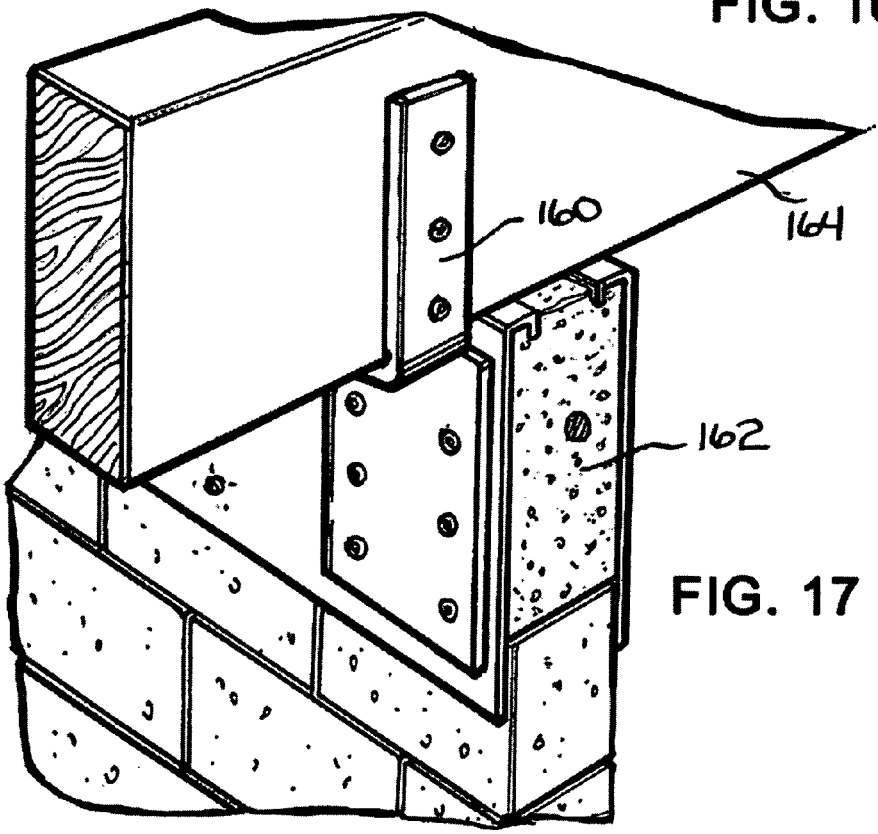
FIG. 17

TIE BEAM FORMATION APPARATUS AND METHOD

FIELD OF THE INVENTION

This invention relates to apparatus for use in the formation of tie beams in block wall construction type buildings and methods of use.

BACKGROUND OF THE INVENTION

In the construction of buildings using blocks, including cement blocks, cinder blocks, various types of bricks, etc., it is necessary to construct a tie beam on the upper surface of the final row of blocks. The tie beam not only provides support for holding or anchoring the blocks fixedly in place but also provides a support or anchor for roof beams. To perform this support or anchoring objective to the fullest, it is generally preferred that the tie beam extend as far as possible in a continuous or integral unit and, preferably, completely around the structure or building.

In the prior art, tie beams are produced by constructing cement forms, generally of wood or some convenient material, and then pouring the forms full of concrete. The concrete is allowed to dry and the forms are then removed and the remainder of the building, e.g. roof, etc., is completed. This process is a very labor intensive project and can take several men four or five days to complete. For example, a tie beam on a relatively small building (e.g. a few thousand square feet), could easily occupy four to six men for five or six days.

It would be highly advantageous, therefore; to remedy the foregoing and other deficiencies inherent in the prior art.

Accordingly, it is an object the present invention to provide new and improved tie beam formation apparatus and method of use.

A further object of the present invention is to provide new and improved tie beam formation apparatus that greatly reduces the time and effort required to produce tie beams in block construction buildings.

Another object of the present invention is to provide a new and improved tie beam formation apparatus that is easy to use and that reduces cost by reducing time and labor.

SUMMARY OF THE INVENTION

The above objects are at least partially solved and the above objects and others are realized in new and improved tie beam formation apparatus including parallel opposed sidewalls defining a channel constructed to receive concrete for the formation of a tie beam. The sidewalls are disposed to become a fixed part of the tie beam. The apparatus further includes mounting structure attached to the sidewalls for holding the sidewalls in the channel defining position. The mounting structure is designed to hold the sidewalls on an upper surface of a block wall and to engage the sidewalls with the block wall at regular intervals. The mounting structure is further designed to allow a flow of concrete into openings in the block wall at spaced apart regular intervals.

The invention also proposes an embodiment of tie beam formation apparatus including parallel opposed sidewalls defining a channel constructed to receive concrete for the formation of a tie beam, with the sidewalls disposed to become a fixed part of the tie beam. In this embodiment the apparatus further includes mounting structure including a plurality of regularly spaced support structures each including a pair of parallel opposed vertical sections held in place by upper and lower cross sections with downwardly extending support sections positioned to be inserted into openings in the top of a block wall. The mounting structure is also disposed to become a fixed part of the tie beam. Also in this embodiment the mounting structure is attached to the sidewalls and holds the sidewalls in the channel defining position. Further, the mounting structure includes blocking material positioned to allow a flow of concrete into openings in the block wall at spaced apart regular intervals.

BRIEF DESCRIPTION OF THE DRAWINGS

The foregoing and further and more specific objects and advantages of the invention will become readily apparent to those skilled in the art from the following detailed description taken in conjunction with the drawings in which:

FIG. 9 is a partially exploded perspective view of a corner of the tie beam formation apparatus of FIG. 1;

FIG. 10 is a view in top plan of the corner of the tie beam formation apparatus of FIG. 9 assembled and completed;

FIG. 11 is a perspective view of another embodiment of tie beam formation apparatus in accordance with the present invention;

FIG. 12 is an end view of the tie beam formation apparatus of FIG. 11;

FIG. 13 is a side view of one method and apparatus for anchoring the tie beam to the block wall;

FIG. 15 is a side view of a block wall with a tie beam formed in accordance with the present invention anchoring the upper flight or row of blocks and a portion of a roof attached to the tie beam;

FIG. 16 is an end view of the block wall, tie beam, and roof assembly of FIG. 15; and FIG. 17 is an enlarged perspective view of a portion of the block wall, tie beam, and roof assembly of FIG. 15 illustrating the connection of a roof beam.

DETAILED DESCRIPTION OF THE PREFERRED EMBODIMENTS

Figure 1:
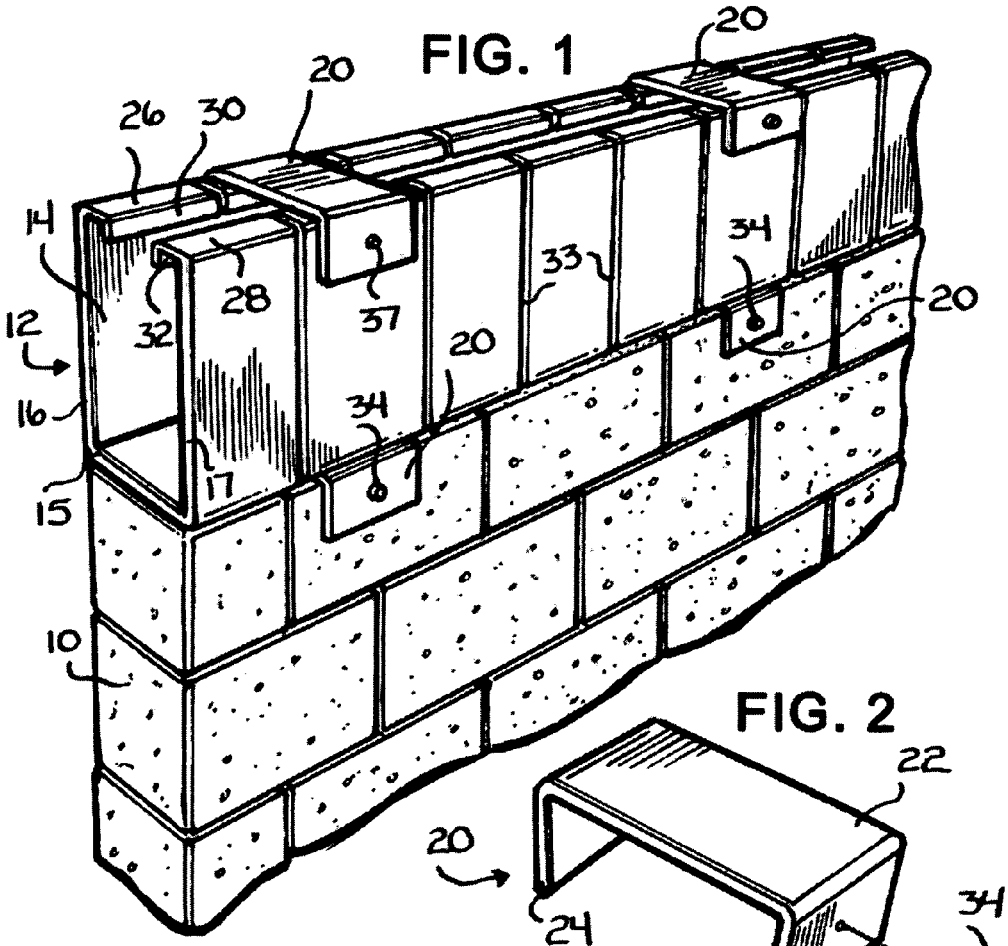
FIG. 1 is a perspective view illustrating a block wall with tie beam formation apparatus attached thereto in accordance with the present invention.
Figure 2:
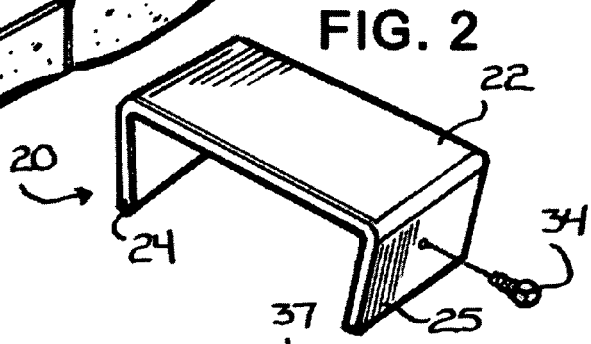
FIG. 2 is a perspective view of a yoke used in the tie beam formation apparatus of FIG. 1.

Turning to the drawings, in which like reference characters indicate corresponding elements throughout the several views, attention is first directed to FIG. 1, which illustrates a block wall 10 with tie beam formation apparatus 12 attached thereto in accordance with the present invention. Apparatus 12 includes an elongated trough or channel 14 with a bottom wall or base 15 and vertical sidewalls 16 and 17. Preferably, base 15 extends horizontally approximately the same width as the width of the blocks in block wall 10. Further, vertical sidewalls 16 and 17 are approximately in a common plane with the sides of block wall 10 so as to substantially form an extension of block wall 10. It will of course be understood by those skilled in the art that some minor size and position discrepancies can occur in blocks and in the construction of block wall 10 so that exact measurements are generally not possible or practical.

A plurality of U-shaped yokes 20 are provided in conjunction with trough or channel 14. Each yoke 20 is constructed with a flat connecting portion 22 and vertical sides 24 and 25. Connecting portion 22 is approximately the same length as the width of the blocks in block wall 10 so that vertical sides 24 and 25 extend along and partially overlie the outer surface of block wall 10. Also, because vertical sidewalls 16 and 17 of trough or channel 14 are spaced apart the same distance as the sides of block wall 10, yokes 20 can be used at the upper ends to hold vertical sidewalls 16 and 17 together and prevent spreading or the like.

Figure 5:
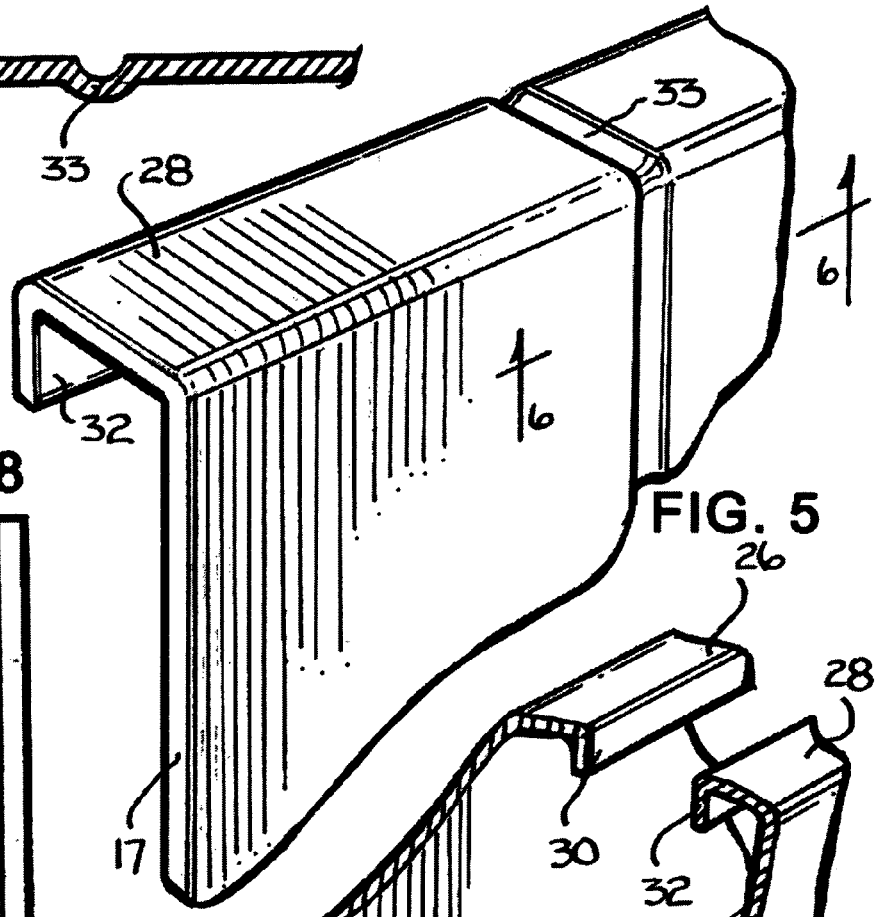
FIG. 5 is an enlarged view of a portion of the tie beam formation apparatus of FIG. 1.
Figure 7:
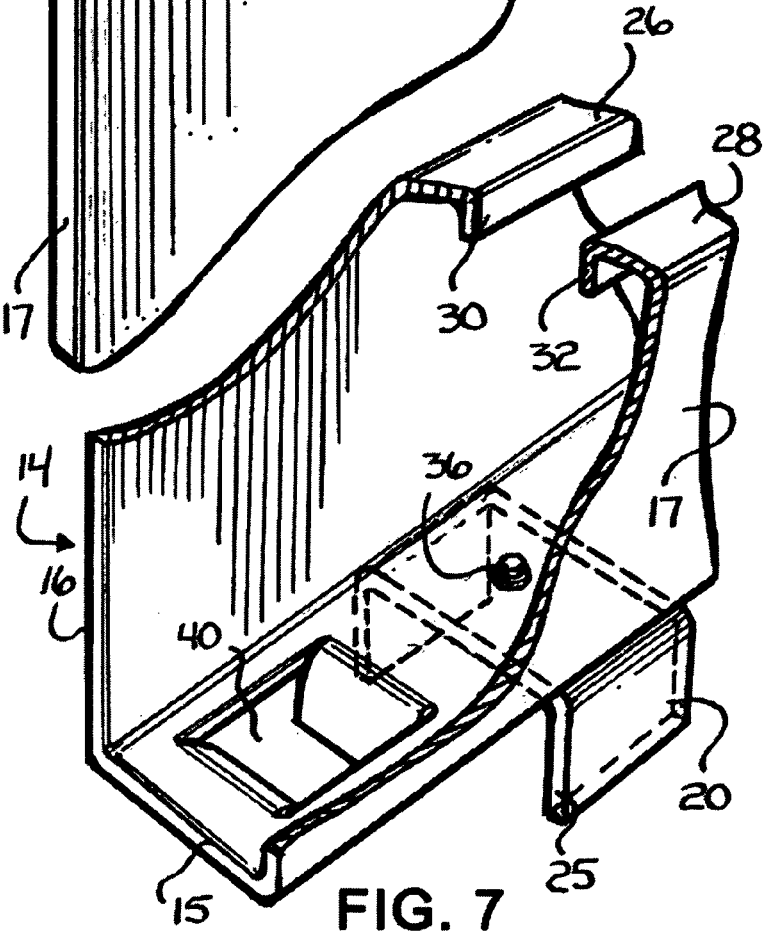
FIG. 7 is a perspective view of the tie beam formation apparatus of FIG. 1, portions thereof broken away and shown in section to better display the inner construction.

As can best be seen in FIGS. 5 and 7, the upper ends of vertical sidewalls 16 and 17 are each turned inwardly a short distance to define upper surfaces 26 and 28, respectively, with the extreme end turned vertically downwardly to form flanges 30 and 32, respectively. Thus, the upper end of vertical sidewall 16 is turned inwardly to form upper surface 26 and the extreme end is turned downwardly to form flange 30. Similarly, the upper end of vertical sidewall 17 is turned inwardly to form upper surface 28 and the extreme end is turned downwardly to form flange 32. Upper surfaces 26 and 28 not only provide an upper surface for the tie beam but, in conjunction with flanges 30 and 32, provide substantial additional support and strength to the tie beam. As will be understood by those skilled in the art, flanges 30 and 32 are spaced apart a sufficient distance to allow the convenient pouring of wet concrete into trough or channel 14. It should be understood that the term "concrete" as used throughout this disclosure is meant to include any of the well known curable materials used in the construction of buildings and the like.

Figure 6:
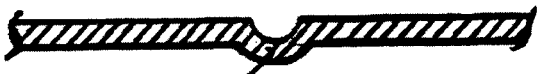
FIG. 6 is a partial sectional view of a wall as seen from the line 6-6 of FIG. 5.

Also, as can be seen in FIGS. 5 and 6, shallow breaks or grooves 33 are formed in the material of trough or channel 14 at regular intervals to increase the rigidity. Grooves 33 extend completely around the periphery of trough or channel 14 generally perpendicular to the length or longitudinal axis. In the preferred embodiment, trough or channel 14 is formed of some convenient sheet metal (i.e. sheet steel, etc.) or the like and is formed using well known bending or metal breaking processes and machines. As will be understood by those skilled in the sheet metal art, trough or channel 14 will begin as an elongated sheet of flat material. Grooves 33 are then formed at regular intervals. The flat sheet is then bent to form trough or channel 14. Also, the skilled artisan will know that trough or channel 14 can be constructed with lengths to fit specific applications or in convenient standard lengths that can be easily interconnected for general applications.

Figure 3:
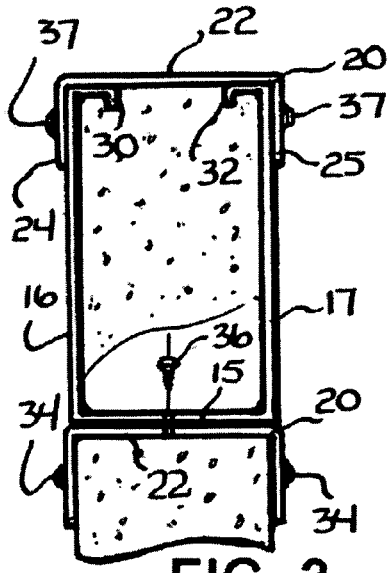
FIG. 3 is an end view of a tie beam incorporating the tie beam formation apparatus of FIG. 1.

A plurality of yokes 20 are provided to firmly connect trough or channel 14 to the upper surface of block wall 10. Yokes 20 are spaced approximately uniformly, or as convenient, along the entire length of trough or channel 14, as best seen in FIG. 1. Each lower yoke 20 is attached to block wall 10 by screws 34, one each extending through vertical sides 24 and 25 and into the upper flight of blocks in block wall 10. Trough or channel 14 is attached to connecting portion 22 of each lower yoke 20 by a screw 36 that extends through base 15 and into connecting portion 22, as seen in FIG. 3. It will of course be understood that lower yokes 20 can be attached to trough or channel 14 and then the entire assembly positioned on block wall 10 or lower yokes 20 can be affixed to block wall 10 and trough or channel 14 positioned and attached subsequently, whichever is most convenient.

Figure 4:
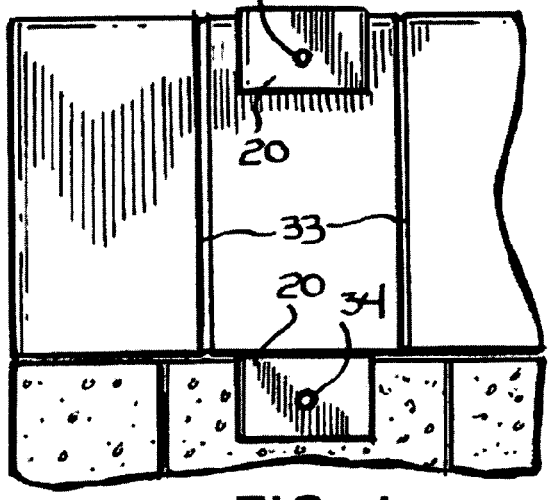
FIG. 4 is a side view of the tie beam illustrated in FIG. 3.

Also, a plurality of yokes 20 are positioned in a regular spaced relationship along the upper surface of trough or channel 14, as can be seen in FIG. 1. In this application, connecting portion 22 of each upper yoke 20 lies flat on upper surfaces 26 and 28 of trough or channel 14 with vertical sides 24 and 25 extending downwardly along a portion of vertical sidewalls 16 and 17, respectively. Screws 37 are engaged through vertical sides 24 and 25 and into vertical sidewalls 16 and 17, as seen in FIGS. 3 and 4. These upper yokes 20 prevent horizontal spreading of vertical sidewalls 16 and 17 when trough or channel 14 is filled with wet concrete. It will of course be understood that the upper yokes 20 can remain in position as a fixed component of the finished tie beam or they can be removed after the concrete has dried sufficiently, if desired.

Figure 8:
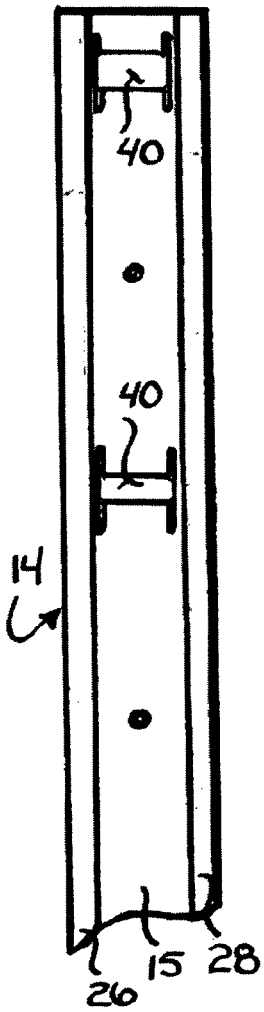
FIG. 8 is a view in top plan of the tie beam formation apparatus of FIG. 1.

During the formation of trough or channel 14, as described above, openings 40 are formed in bottom wall or base 15 at regular intervals, as can be seen in FIG. 8. For example, openings 40 are formed so as to approximately coincide with an opening in every fourth block in block wall 10. Opening 40 can be conveniently formed by simply breaking the material of base 15 downwardly, as illustrated in FIG. 7. Openings 40 provide a port or inlet for the flow of concrete into regularly spaced openings in block wall 10 for additional strength and coupling of the tie beam to block wall 10.

Thus, as explained above, trough or channel 14 can be constructed with lengths to fit specific applications or in convenient standard lengths. In this fashion trough or channel 14 extends the entire length of all sides of a block wall 10, as illustrated in FIGS. 9 and 10. When a corner is reached, such as ninety degree corner 45, illustrated in FIGS. 9 and 10, several different procedures can be performed, depending upon the specific application and the convenience required. For example, each trough or channel 14 can be terminated in approximately the plane of the joining inner wall. Inner and outer ninety degree angle brackets 46 and 48, respectively, are provided with a horizontal width sufficient to overlie a short portion of each vertical sidewall 16 or 17 and to extend vertically from upper surface 26 or 28 to a short distance along the surface of block wall 10. Brackets 46 and 48 are held in position by screws 49 extending through each bracket 46 or 48 and into vertical sidewall 16 or 17 or block wall 10.

Alternatively, one of the trough or channel 14 extending along the joining sides can be extended to the plane of the outer surface of the joining wall. In this fashion one outer surface of a trough or channel 14 will simply terminate the other trough or channel and a ninety degree bracket or flat piece can be attached to terminate the other trough or channel 14.

Once the entire tie beam formation apparatus 12 is assembled, wet concrete can be conveniently poured into each trough or channel 14 so that some of the concrete flows through openings 40 and into communicating openings in block wall 10. The concrete is poured to fill trough or channel 14 to upper surfaces 26 and 28 of trough or channel 14 and so as to encompass flanges 30 and 32, as illustrated in FIG. 3. During the pouring process, upper yokes 20 prevent horizontal spreading of vertical sides 16 and 17. Once the pouring is completed and the concrete has substantially set, upper yokes 20 may be removed if desired or they may be retained for additional support.

Turning now to FIGS. 11 through 14 another embodiment of tie beam formation apparatus 112, is illustrated connected to a block wall 110. Apparatus 112 includes regularly spaced support structures 115 formed and positioned to engage and hold sidewalls 116 and 117 so as to form a trough or channel 114 in communication with the upper surface of block wall 110. Trough or channel 114 is then filled with concrete and allowed to cure or dry to form a tie beam along the top of block wall 110. As will be seen in more detail from the description below, support structures 115 and sidewalls 116 and 117 become a permanent part of the tie beam.

Figure 14:
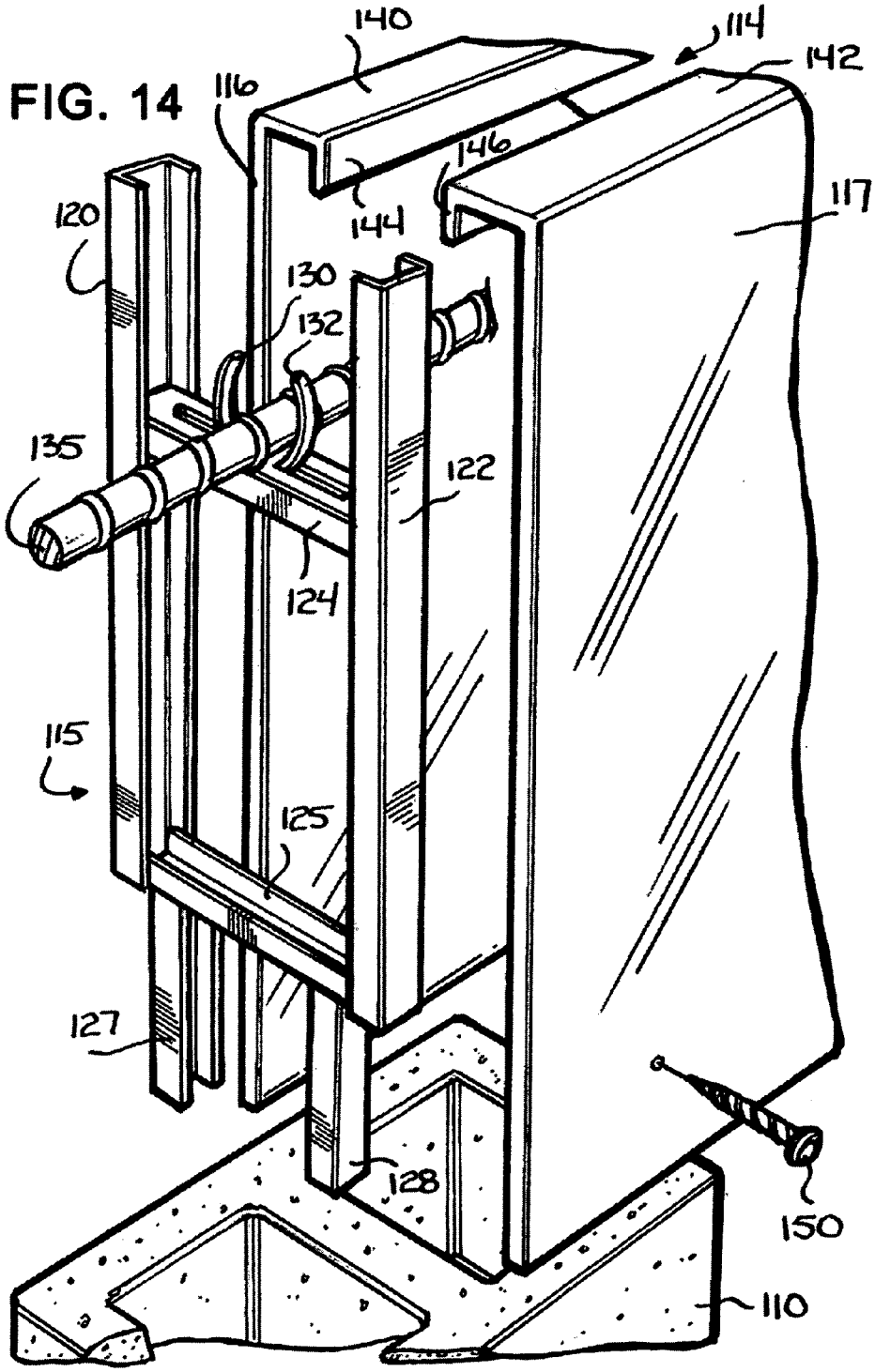
FIG. 14 is an enlarged view in perspective, partially exploded, illustrating the inter-relation of the components of the tie beam formation apparatus of FIG. 11.

In this specific embodiment, support structures 115 are each constructed the same, as a standard unit and, therefore, only one structure will be described in detail. Referring specifically to FIG. 14, support structure 115 is formed of sections of channel that can be any convenient material, such as steel, aluminum, etc. The channel sections included in support structure 115 are two vertical side sections 120 and 122, an upper and a lower horizontal cross section 124 and 125, respectively, and two spaced apart downwardly extending support sections 127 and 128.

Vertical side sections 120 and 122 are positioned in spaced apart relationship with the channels of the sections facing each other. Upper and a lower horizontal cross section 124 and 125 are then positioned with their ends engaged in the channels of sections 120 and 122 for additional support and strength. Support sections 127 and 128 are attached in a downwardly extending relationship to the lower surface of lower cross section 125. Support sections 127 and 128 are spaced apart approximately the same distance as the width of an opening in a block, as can be seen best in FIG. 12. The vertical height of side sections 120 and 122 is approximately the desired height that the tie beam extends above block wall 110. Here it will be understood that the various sections of support structure 115 can be affixed together in any of a variety of methods, including welding, screws, wires, etc.

Upper cross section 124 has a pair of opposed fingers 130 and 132 broken from the web of the channel, using any well known sheet metal breaking apparatus. In this embodiment, fingers 130 and 132 are positioned approximately centrally in upper cross section 124 and extend upwardly therefrom. In the process of assembling tie beam formation apparatus 112, a plurality of support structures 115 are positioned approximately in the desired regular or spaced apart position on the top of block wall 110, with support sections 127 and 128 extending down into openings in the top of block wall 110. An elongated piece of material 135, such as rebar or the like, is positioned between opposed fingers 130 and 132 relative to each support structure 115 to which it is to be attached. The various support structures 115 can then be straightened vertically, if needed, and positioned accurately at the desired location. Once each support structure is properly positioned, the opposed fingers 130 and 132 on that structure are tightened about elongated piece 135, as illustrated in FIG. 12.

In some specific applications it may be desirable to use a long L-shaped steel bolt 138, see FIG. 13, to fixedly hold support structures 115 in place, rather than or in addition to elongated piece 135. Bolt 138 is constructed to be engaged under one of the webs in an upper block of block wall 110. The threaded end extends upwardly through, for example, an opening in lower cross section 125 of support structure 115. A nut and washer, if necessary, is engaged to hold support structure 115 fixedly in place.

Here it should be noted that sidewalls 116 and 117 are formed separately and are essentially mirror images of each other. The upper ends of sidewalls 116 and 117 are turned inwardly (as viewed in FIG. 11, 12, or 14) to form upper flat surfaces 140 and 142, respectively. The extreme edges of sidewalls 116 and 117 are turned downwardly to form spaced apart flanges 144 and 146. It can be seen that support structures 115 are constructed so that flanges 144 and 146 of sidewalls 116 and 117 can be easily engaged over the upper ends of side sections 120 and 122 to hold sidewalls 116 and 117 in place. Further, sidewalls 116 and 117 are constructed to extend downwardly over a portion of the upper blocks in block wall 110. To fix tie beam formation apparatus 112 in place screws 150, or the like, are inserted through sidewalls 116 and 117 and into the sides of the upper block in block wall 110.

Here it will be understood by those skilled in the art that tie beam formation apparatus 112 can be completely pre-assembled and placed on the upper surface of block wall 110 in this condition. For pre-assembly it is desirable to attach, at least temporarily if not permanently, sidewalls 116 and 117 to support structures 115 by some convenient means, such as spot welding or the like (see for example points 143 in FIG. 12).

As described above, upper flat surfaces 140 and 142 and flanges 144 and 146 are formed to provide sufficient opening therebetween to allow the introduction of wet concrete into trough or channel 114 to fill it to upper flat surfaces 140 and 142 so as to encompass flanges 144 and 146. Here it should be noted that concrete introduced into trough or channel 114 will flow into the openings in block wall 110, completely filling the wall, if additional precaution is not taken. In this embodiment it is anticipated that all but a few of the openings will be covered with some convenient material, such as mesh, cloth, paper, etc. prior to pouring the concrete. The regular openings remaining open so as to be filled with concrete can include, for example, the openings into which support sections 127 and 128 are inserted. Encasing support sections 127 and 128 in concrete will add additional support and strength to the tie beam.

Turning now to FIGS. 15, 16, and 17, one specific means is illustrated for connecting roof beams and rafters to a tie beam constructed in accordance with the present invention. In the figures, a tie beam constructed using tie beam formation apparatus 112 is illustrated but it will be understood that the same or similar construction can use tie beams constructed using tie beam formation apparatus 12, or any other apparatus formed in accordance with the present invention. Standard preformed beam holding brackets 160 are positioned along a tie beam formed in accordance with the present invention. Brackets 160 are affixed to tie beam 162 by any convenient means, such as screws, nails, etc. Beams 164 are then placed in the upwardly directed yoke portions of brackets 160 and fixed in place by some convenient means, such as screws, nails, etc. Rafters 166 (see FIG. 16) are then attached to beams 164 in the standard fashion.

Thus, new and improved tie beam formation apparatus and methods of use have been disclosed. The new and improved tie beam formation apparatus greatly reduces the time and effort required to produce tie beams in block construction buildings. Further, the new and improved tie beam formation apparatus is easy to use and reduces cost by reducing time and labor.

The invention has been described above with reference to one or more preferred embodiments. However, those skilled in the art will recognize that changes and modifications may be made in the described embodiments without departing from the nature and scope of the invention. For instance, the specific size, shape, or material may vary in accordance with specific applications.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. Tie beam formation apparatus comprising:

parallel opposed sidewalls defining a channel constructed to receive concrete for the formation of a tie beam, the sidewalls being disposed to become a fixed part of the tie beam; and mounting structure attached to the sidewalls and holding the sidewalls in the channel defining position, the mounting structure being further designed to hold the sidewalls defining the channel on an upper surface of a block wall and to engage the sidewalls with the block wall at regular intervals, and the mounting structure being further designed to allow a flow of concrete into openings in the block wall at spaced apart regular intervals, the mounting structure includes a plurality of regularly spaced downwardly extending sections affixed to the sidewalls and attachable to the block wall for engaging the sidewalls with the block wall at regular intervals.

2. Tie beam formation apparatus as claimed in claim 1 wherein the parallel opposed sidewalls are formed of sheet metal.

3. Tie beam formation apparatus as claimed in claim 1 wherein each of the plurality of regularly spaced downwardly extending sections includes a generally U-shaped yoke with a flat connecting portion attached to the base and vertical sides extending downwardly so as to overlie a portion of a side of a block wall when the apparatus is applied to the block wall.

4. Tie beam formation apparatus as claimed in claim 3 wherein the mounting structure includes a second plurality of yokes engaged with upper edges of the sidewalls at regular intervals to prevent spreading of the channel during the receipt of concrete therein.

5. Tie beam formation apparatus comprising:

parallel opposed sidewalls and a connecting base defining a channel constructed to receive concrete for the formation of a tie beam on a block wall, the sidewalls and the base being disposed to become a fixed part of the tie beam;

a first plurality of generally U-shaped yokes each including a connecting portion and spaced apart vertical end portions, the connecting portion of each of the first plurality of yokes being attached to a lower surface of the base with the vertical end portions positioned to engage outer surfaces of a block wall; and a second plurality of generally U-shaped yokes each including a connecting portion and spaced apart vertical end portions, the connecting portion of each of the second plurality of yokes being positioned in overlying relationship with upper ends of the sidewalls and the vertical end portions engaging outer surfaces of the sidewalls.

6. Tie beam formation apparatus as claimed in claim 5 wherein the parallel opposed sidewalls and connecting base are formed of sheet metal.

7. Tie beam formation apparatus as claimed in claim 5 wherein the base is further designed to allow a flow of concrete into openings in the block wall at spaced apart regular intervals.

* * * * *